United States Patent [19]

Thurston

[11] Patent Number: 4,516,109

[45] Date of Patent: May 7, 1985

[54] ROAD BARRICADE FLASHER LIGHT COMBINATION

[76] Inventor: Kurt W. Thurston, Reno, Nev.

[21] Appl. No.: 462,980

[22] Filed: Feb. 1, 1983

[51] Int. Cl.[3] ..... E01F 9/01

[52] U.S. Cl. ..... 340/114 B; 340/114 R; 340/81 R; 340/50; 116/63 R; 362/190; 362/191

[58] Field of Search ..... 340/114 B, 81 R, 114 R, 340/50; 362/84, 190, 191, 200, 367, 368, 370, 371, 378; 403/11, 19, 24; 43, 61, 287, 389; 256/64; 904/6; 116/63

[56] References Cited

U.S. PATENT DOCUMENTS

| | | | |
|---|---|---|---|
| 2,648,761 | 8/1953 | Shamel | 340/114 B |
| 2,800,601 | 7/1957 | Martin et al. | 340/81 |
| 3,135,468 | 6/1964 | Osborn | 340/114 B |
| 3,321,742 | 5/1967 | Nunn | 340/114 B |
| 3,577,122 | 5/1971 | Lapham | 340/114 B |
| 3,697,738 | 10/1972 | Decker et al. | 340/81 R |
| 3,818,439 | 6/1974 | Maine | 340/114 B |
| 4,001,778 | 1/1977 | Ross | 340/114 B |
| 4,069,404 | 1/1978 | Minoprio et al. | 340/114 B |

*Primary Examiner*—John W. Caldwell, Sr.
*Assistant Examiner*—Tyrone Queen
*Attorney, Agent, or Firm*—Flehr, Hohbach, Test, Albritton & Herbert

[57] ABSTRACT

A road barricade flasher light combination includes a bracket connecting the flasher light to the hinge pin of a barricade. The bracket is in the form of a lever having a slotted aperture which is permanently fastened to the hinge pin and a cup-shaped recess with an aperture through which the normal threaded bolt of the flasher light extends. The assembly allows pivotal action for installation of the light and then later movement of it into a position on the saddle formed by the top bracket of the barricade.

9 Claims, 3 Drawing Figures

ROAD BARRICADE FLASHER LIGHT COMBINATION

The present invention is directed to a road barricade flasher light combination having a theft proof cup bracket.

At the present time, road barricades are manufactured both of a wood and metal combination and entirely of plastic. An example of a plastic barricade is one produced by the Best Barricade Division of Glass Plastics Corporation. With both of these types of barricades, when a flasher light is used in conjunction with the barricade, it must be fastened securely to the barricade to both position it to maintain the flashing light in the proper position and so that it is theft proof. One technique which has been done in the past to fasten the flasher light to the barricade is to use a hinge pin which connects the typical two legs of the barricade and provides a special bolt which extends both through the hinge and into the flasher light. And then for theft prevention the head of the bolt is of a special anti-theft configuration. A cup may also be placed around the bolt head to deter tampering. The light usually rests on the adjacent saddle formed by a pair of the top bars of the barricade.

The difficulty here is that because of the several different types of barricades and in turn different types of flasher lights having varying thicknesses special bolts and lights must be stocked for each type of barricade; in other words, there is little interchangeability. And then when there is interchangeability the ability to position the light accurately and also to prevent theft may be diminished.

Thus, it is an object of the present invention to provide an improved road barricade flasher light combination.

In accordance with the above object, there is provided a road barricade flasher light combination where the barricade is in the form of a pair of legs hinged together at the top by at least one hinge pin and having an adjacent saddle formed by a pair of the top bars of the barricade. The flasher light has a lower body portion containing a battery and a light source extending from the top of the lower body portion. The body portion has a socket for receiving a threaded bolt. The improvement comprises a bracket means having an elongated lever with first and second aperture means at the two ends of the lever; the first aperture means is slotted and receives the hinge pin which is freely slidable in the slot. Fastening means permanently attach the bracket means to the barricade via the hinge pin. The second aperture means includes a cup-shaped recess having an aperture through which a threaded bolt extends and is screwed into the socket in the flasher body; the head of the bolt is recessed in the cup-shaped recess to prevent tampering. The flasher body is rotatable on the axis of the second threaded bolt. The first and second aperture means are spaced the approximate distance between the respective axes of the hinge pin and the socket in the flasher body when the bottom of the body is resting on the saddle.

Figure 1:
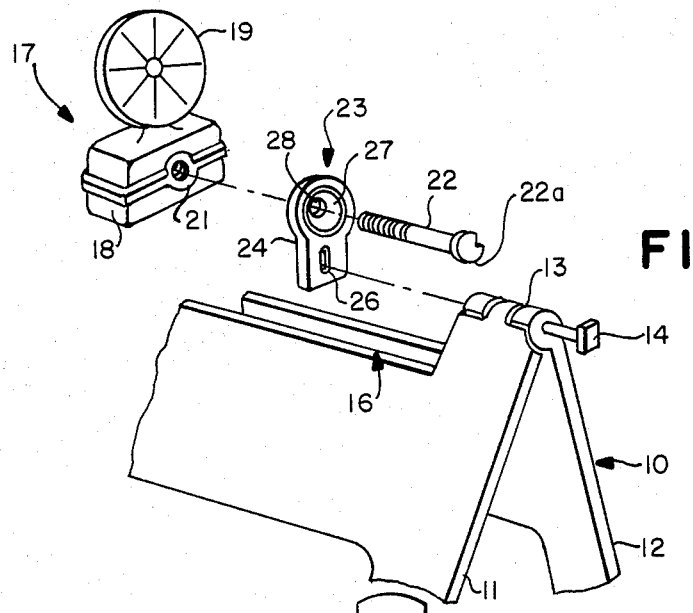
FIG. 1 is a perspective and exploded view illustrating the present invention.

Referring first to FIG. 1, the barricade 10 has a pair of legs 11 and 12 which are hinged at 13 by a hinge pin 14. Adjacent to hinge 13 is a lower adjacent saddle 16 formed by the top bars of the legs 11 and 12.

A flasher light 17 has a lower body portion 18 containing a battery, a light source 19 extending from the top of the lower body portion, and a socket 21 for receiving the threaded bolt 22.

A bracket 23 is in the form of an elongated lever 24 having a first aperture means in the form of a slot 26 at one end of the lever and a second aperture means at the other end in the form of a cup-shaped recess 27 having an aperture 28. Hinge pin 14 is insertable through slot 26 and allows the bracket 23 to be permanently fastened to the barricade 10 by a nut 29 which is screwed to the end of the hinge pin 14. For theft prevention, the nut is either tack welded or the threads peened. Thus, this forms a permanent bracket barricade combination. Further, bolt 22 extends through aperture 28 of the cup-shaped recess 27 so that it may be screwed into the body 18 of the flasher light to fasten the flasher light to the bracket as illustrated in FIG. 2.

Figure 3:
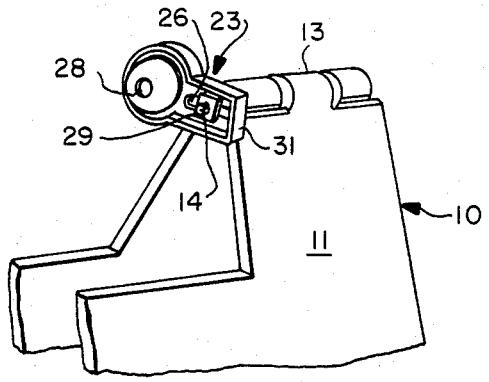
FIG. 3 is a partial perspective view showing only the barricade and the bracket combination with the flasher light removed.

In partial summary, as shown in FIG. 3, the bracket 23 is permanently attached to the barricade 10. But at the same time it is freely rotatable since first the nut 29 is not tightened fully against the hinge 13 and also the slot 26 allows movement.

Figure 2:
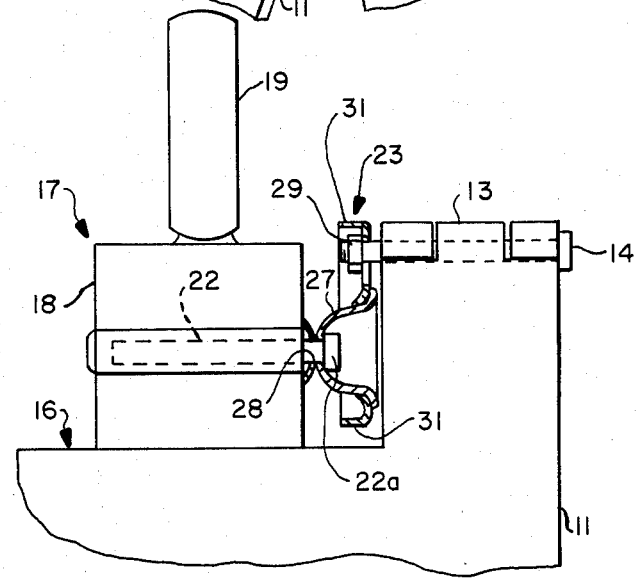
FIG. 2 is a partial elevational view of FIG. 1 in its assembled state.

From the standpoint of the flasher 17 itself, as illustrated in FIG. 2, the deep recess provided by the cup 27 prevents tempering with the head 22*a*. Also head 22*a* is of a standard tamper proof head configuration as illustrated in FIG. 1 where the head is circular except for a single notch in its periphery; it thus requires a special removal tool as opposed to a standard socket wrench.

Bracket 23 also includes an integral peripheral shoulder 31 especially around the nut 29 which while providing structural rigidity to the bracket also provides, as best shown in FIG. 3, a protective ridge around slot 26 to hinder tampering with the fastener or the nut 29.

Finally, as best illustrated in FIG. 2, cup-shaped recess 27 of the bracket 23 is an independent metal part which is affixed to an aperture in the bracket by a suitable press and/or welding procedure. The use of an independent metal part for the cup-shaped recess 27 is believed to enable a deeper recess to be made for effective tamper proofing as opposed to the use of a single pressed metal part.

The aperture 28 of the cup 27 and the aperture formed by the slot 26 are spaced the approximate distance between the respective axes of the hinge pin 14 and the socket 21 in flasher body 18. Thus, as illustrated in FIG. 2, in the final installed mode, the flasher body 18 rests firmly on saddle 16. At the same time, the slot 26 allows different flasher bodies with different heights to be accommodated.

To utilize the present invention on, for example, a plastic-type barricade, the following procedures are used:

(1) Remove the unbutted plastic hinge pin and replace it with pin or carriage bolt 14.

(2) Attach the bracket 23 with the recess of the cup 27 facing the hinge and firmly secure with the jam nut 29.

(3) Sting or tack weld the bolt to the nut or peen the threads of the bolt 14.

(4) Attach any standard flasher with the existing bolt 22 of the flasher through the aperture 28 of the cup 27.

(5) Rotate the bracket to one side and screw the tamper proof bolt 22 into the flasher light as tightly as possible.

(6) Rotate the entire flasher light and bracket assembly back to the normal perpendicular position and adjust the flasher light so that it rests firmly on the top bars or saddle 16 of the barricade.

From the foregoing, it is obvious that if it is desired to remove the flasher light because of a broken flasher lens 19 or change the battery, the hinge or bracket 23 allows the light to be rotated again to the side and the bolt 22 removed.

If desired for some applications, the bracket 23 may be reversed where it is rotated on both its vertical and horizontal axes by 180° as illustrated in FIG. 1. Then the cup-shaped recess 27 is attached to the bolt 14 and the slotted portion 26 to the flasher body 18. This still provides some protection because of the recess provided by the peripheral shoulder 31 to the removal of bolt 22.

Thus, an improved road barricade flasher light combination has been provided which is applicable to metal-wood as well as plastic barricades—in fact any barricade that requires a hinge pin. With the use of a permanent bracket-barricade combination, the flasher light is easily removed for maintenance or if not needed. At the same time, all of the barricades at a particular job location may be equipped with a bracket to allow flasher lights to be easily attached when needed.

What is claimed:

1. A road barricade flasher light combination where the barricade is in the form of a pair of legs each leg having a top bar and hinged together at the top by at least one hinge pin and having an adjacent saddle formed by a pair of the top bars of the barricade, the flasher light having a body portion containing a battery and a light source extending from the top of the body portion, the body portion having a socket for receiving a threaded bolt, the improvement comprising:

bracket means having an elongated lever with first and second aperture means at the two ends of the lever, said first aperture means being slotted and receiving said hinge pin which is freely slidable in said slot; fastening means for permanently attaching said bracket means to said barricade via said hinge pin; said second aperture means including a cup-shaped recess having an aperture through which said threaded bolt extends and is screwed into said socket in said body portion, the head of such bolt being recessed in said cup-shaped recess to prevent tampering; said body portion being rotatable on the axis of said threaded bolt, said first and second aperture means being spaced the approximate distance between the respective axes of said hinge pin and said socket in said body portion when the bottom of said body portion is resting on said saddle.

2. The combination as in claim 1 where said fastening means includes a nut on the end of said hinge pin.

3. The combination as in claim 2 where said nut is tack welded to said pin.

4. The combination as in claim 1 where said head of said recessed bolt is of a tamper proof configuration which cannot be engaged by a standard socket wrench.

5. The combination as in claim 1 where said cup-shaped recess of said lever is an independent metal part which is affixed to said bracket means.

6. The combination as in claim 1 where said bracket means includes an integral peripheral shoulder for providing structural rigidity to said lever.

7. The combination as in claim 6 where said shoulder provides a protective ridge around said slot of said first aperture means to hinder tampering with said fastening means.

8. A road barricade flasher light combination where the barricade is in the form of a pair of legs each leg having a top bar and hinged together at the top by at least one hinge pin and having an adjacent saddle formed by a pair of the top bars of the barricade, the flasher light having a body portion containing a battery and a light source extending from the top of the body portion, the body portion having a socket for receiving a threaded bolt, the improvement comprising:

bracket means having an elongated lever with first and second aperture means at the two ends of the lever, said first aperture means being slotted and said second aperture means including a cup-shaped recess having an aperture, said hinge pin and said threaded bolt extending respectively through one of said first and second aperture means, said threaded bolt being screwed into said socket of said body portion, said body portion being rotatable on the axis of said threaded bolt, said first and second aperture means being spaced the approximate distance between the respective axes of said hinge pin and said socket in said body portion when the bottom of said body portion is resting on said saddle; and fastening means for permanently attaching said bracket means to said barricade via said hinge pin.

9. In a road barricade flasher light combination where the barricade is in the form of a pair of legs each leg having a top bar and hinged together at the top by at least one hinge pin and having an adjacent saddle formed by a pair of the top bars of the barricade, the flasher light having a body portion containing a battery and a light source extending from the top of the body portion, the body portion having a socket for receiving a threaded bolt, the improvement comprising:

bracket means having an elongated lever with first and second aperture means at the two ends of the lever, said first aperture means being slotted and receiving said hinge pin which is freely slidable in said slot; fastening means for permanently attaching said bracket means to said barricade via said hinge pin; said second aperture means including a cup-shaped recess having an aperture through which said threaded bolt is adapted to extend and be screwed into said socket in said body portion.

* * * * *